US010507481B2

(12) United States Patent
Mather

(10) Patent No.: US 10,507,481 B2
(45) Date of Patent: Dec. 17, 2019

(54) FRAGRANCE BOTTLE ASSEMBLY

(71) Applicant: Sillage LLC, Newport Beach, CA (US)

(72) Inventor: Nicole Mather, Newport Beach, CA (US)

(73) Assignee: Sillage LLC, Newport Beach, CA (US)

( * ) Notice: Subject to any disclaimer, the term of this patent is extended or adjusted under 35 U.S.C. 154(b) by 145 days.

(21) Appl. No.: 15/847,789

(22) Filed: Dec. 19, 2017

(65) Prior Publication Data

US 2018/0177279 A1 Jun. 28, 2018

Related U.S. Application Data

(63) Continuation of application No. 14/614,358, filed on Feb. 4, 2015, now abandoned.

(51) Int. Cl.
*B05B 11/00* (2006.01)
*A45D 34/02* (2006.01)

(52) U.S. Cl.
CPC ..... *B05B 11/0038* (2018.08); *B05B 11/0032* (2013.01); *A45D 34/02* (2013.01); *A45D 2200/057* (2013.01)

(58) Field of Classification Search
CPC ..... B05B 11/0038; B05B 11/0032; B05B 11/0027; B05B 11/3059; B65D 83/22; B65D 83/226; B65D 50/00; B65D 43/12; B65D 43/20
USPC ..... 222/153.13; 220/345.1, 345.2, 345.3
See application file for complete search history.

(56) References Cited

U.S. PATENT DOCUMENTS 1,063,630 A * 6/1913 Weeks ..... B65D 43/20 220/345.4
1,897,890 A * 2/1933 Cook ..... B65D 47/286 222/542
4,353,483 A * 10/1982 Pehr ..... B65D 83/40 215/216
5,687,885 A * 11/1997 Turk ..... A61C 9/0026 215/322
5,975,370 A * 11/1999 Durliat ..... B05B 11/0027 222/153.06
6,016,916 A * 1/2000 Ortner ..... A45D 34/02 206/581
7,044,339 B1 * 5/2006 Kuo ..... B05B 11/0032 222/182
8,376,165 B2 * 2/2013 Chiang ..... B65D 47/066 215/229

(Continued)

*Primary Examiner* — Benjamin R Shaw
(74) *Attorney, Agent, or Firm* — Perkins Coie LLP

(57) ABSTRACT

Apparatus, systems, and methods related to a fragrance bottle assembly are disclosed. The fragrance bottle assembly can include a bottle configured to retain an atomizable liquid, the bottle having an upper portion and an interior area, a nozzle head coupled to the upper portion and in communication with the interior area, and a tube coupled to the nozzle head and extending into an interior area for engagement with the liquid. The assembly can also include a cap assembly disposed over the upper portion of the bottle, the cap having an upper surface having an opening through which extends such that the nozzle head protrudes above the upper surface. The cap assembly can further include a nozzle cover connected to and slidably moveable along the second upper surface between a first position spaced away from the nozzle head and a second position covering the nozzle head.

12 Claims, 9 Drawing Sheets

(56) References Cited

U.S. PATENT DOCUMENTS

| | | | | |
|---|---|---|---|---|
| 8,596,498 | B2 * | 12/2013 | Werner | B05B 11/3083 222/132 |
| 2003/0197025 | A1 * | 10/2003 | Cabarroque | B05B 11/0032 222/162 |
| 2004/0011819 | A1 * | 1/2004 | Jennings | A61M 11/00 222/162 |
| 2007/0186924 | A1 * | 8/2007 | Terrasi | B05B 11/0032 128/200.23 |
| 2008/0023575 | A1 * | 1/2008 | Trumble | B05B 11/0038 222/135 |
| 2009/0145905 | A1 * | 6/2009 | Kim | B60P 3/226 220/345.1 |
| 2009/0255958 | A1 * | 10/2009 | Santoni | B05B 11/0008 222/321.1 |
| 2011/0226772 | A1 * | 9/2011 | Adler | B65D 50/046 220/315 |
| 2014/0367385 | A1 * | 12/2014 | Spiegelhoff | B65D 75/5883 220/345.4 |
| 2016/0130048 | A1 * | 5/2016 | Denece | B05B 11/0032 239/569 |
| 2016/0199864 | A1 * | 7/2016 | Quennessen | B05B 11/3083 222/135 |
| 2016/0227902 | A1 * | 8/2016 | Mather | B05B 11/0032 |
| 2017/0028421 | A1 * | 2/2017 | Martines | B05B 11/3049 |

* cited by examiner

FRAGRANCE BOTTLE ASSEMBLY

CROSS REFERENCE TO RELATED APPLICATIONS

This application is a continuation of U.S. application Ser. No. 14/614,358, filed on Feb. 4, 2015, and titled FRAGRANCE BOTTLE ASSEMBLY, which is incorporated herein by reference in its entirety.

TECHNICAL FIELD

The present invention is directed toward bottle assemblies with spray nozzles, including fragrance bottle assemblies with spray nozzles and associated covers.

BACKGROUND

Fragrance bottles generally include spray nozzles operable to atomize liquid contained within the fragrance bottles and emit it the form of a mist. Typical fragrance bottles include removable caps to cover the spray nozzles when not in use. Alternatively, certain fragrance bottles may omit the cap altogether, leaving the spray nozzle exposed and unprotected. Conventional fragrance bottle assemblies each experience drawbacks, which can include insufficient usability and/or limited versatility.

SUMMARY

The present invention provides a fragrance bottle assembly that overcomes drawbacks experienced in the prior art and that provides additional benefits. As an example, at least one aspect of the present technology provides a fragrance bottle assembly comprising a bottle configured to retain an atomizable liquid, the bottle having an interior area and an upper portion, a nozzle head coupled to the upper portion and in communication with the interior area, and a tube coupled to the nozzle head and extending into the interior area for engagement with the liquid. The fragrance bottle further includes a cap assembly disposed over the upper portion of the bottle, the cap assembly comprising an upper surface having an opening through which the nozzle head extends such that the nozzle head protrudes above the upper surface. The cap assembly further includes a nozzle cover connected to and slidably moveable along the upper surface between a first position spaced away from the nozzle head and a second position covering the nozzle head. A retention mechanism is positioned to releasably retain the nozzle cover in the second position.

Another aspect of the present technology provides a fragrance bottle comprising a bottle having an upper portion, and a cap assembly disposed vertically over the upper portion of the bottle. The cap assembly includes an opening configured to receive a nozzle head therein, and a nozzle cover connected to and slidably moveable between a closed position and an open position. In the closed position the nozzle cover is disposed over the second opening, and in the open position the nozzle cover is laterally spaced apart from the second opening.

Another aspect of the present technology provides a cap for a fragrance bottle comprising an upper surface having a nozzle opening, and a nozzle cover connected to and laterally moveable along the upper surface between a closed position disposed over the nozzle opening and an open position laterally spaced apart from the nozzle opening. The nozzle cover is coupled to a spring-biased slide member configured to bias the nozzle cover toward the open position. The cap further includes a retention mechanism configured to engage with the sliding member to releasably retain the nozzle cover in the closed position.

DETAILED DESCRIPTION

The present disclosure describes bottle assemblies in accordance with certain embodiments of the present invention. Several specific details of embodiments are set forth in the following description and figures to provide a thorough understanding of the embodiments. One skilled in the art, however, will understand that the present invention may have additional embodiments, and that other embodiments of the invention may be practiced without several of the specific features described below. Further, one skilled in the art will recognize that the bottle assemblies described herein, including the fragrance bottle assemblies, could be configured in many different arrangements and embodiments. Such variations of the present disclosure may be utilized without deviating from the spirit and scope of the present invention. The various embodiments set forth below are described and shown with a level of detail to provide a thorough understanding of the disclosure. Other structures and systems that may be associated with fragrance bottle assemblies have not been fully discussed to enable a clearer presentation of embodiments of this disclosure.

The embodiments of the bottle assemblies are described herein for purposes of illustration with reference to the relative spatial orientation of the bottle assemblies as shown in the figures. Any directional references regarding upper, lower, left, right, etc., however, are used to describe the assembly in the orientation as illustrated for ease of understanding. The directional orientation shown and described herein is not intended to limit the structure of the bottle assemblies, which can be oriented in spatial orientations different than those shown in the figures.

Figure 1A:
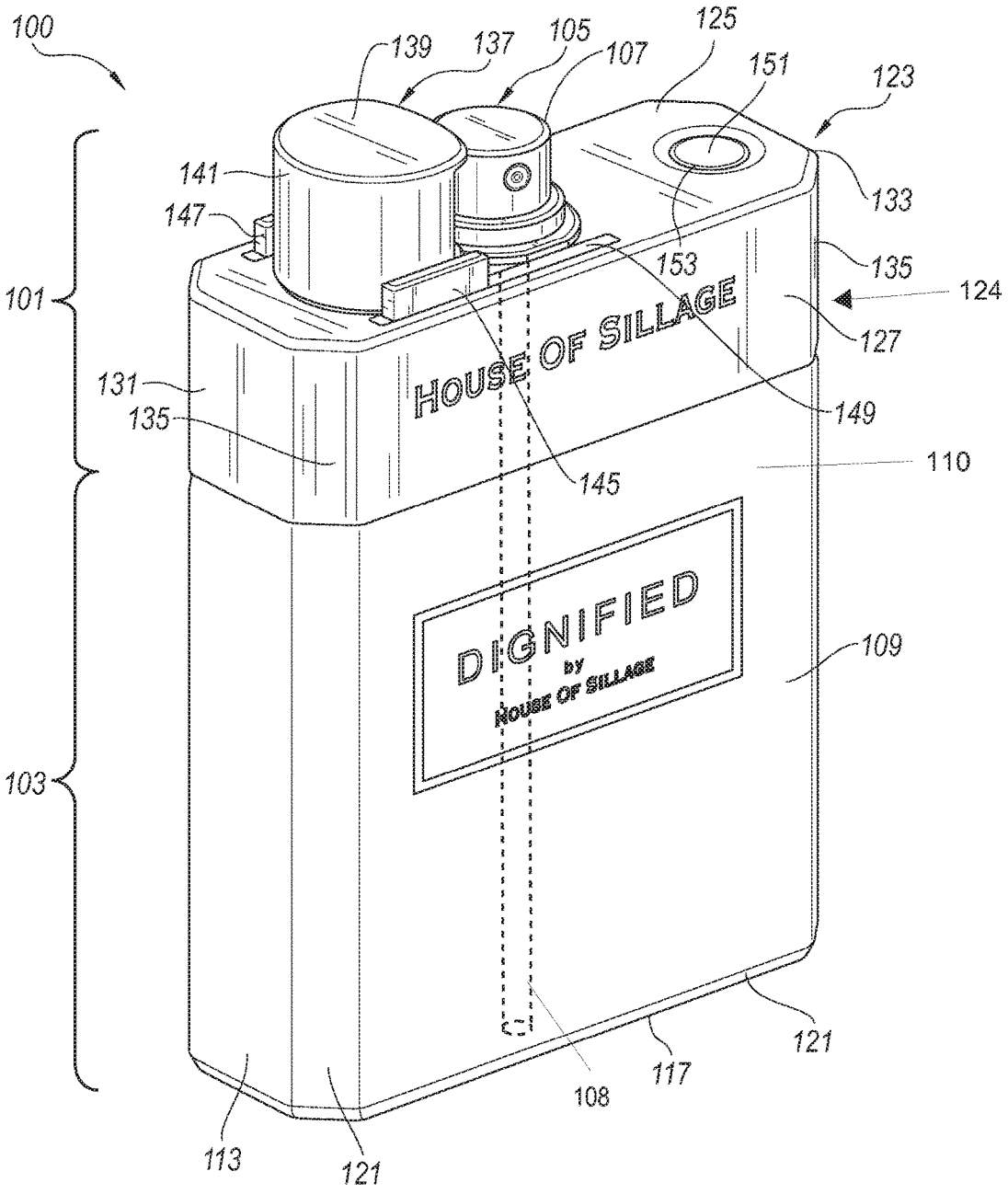
FIG. 1A is a perspective view of a bottle assembly in accordance with an embodiment of the present disclosure, wherein the nozzle cover is shown in an open position.
Figure 1B:
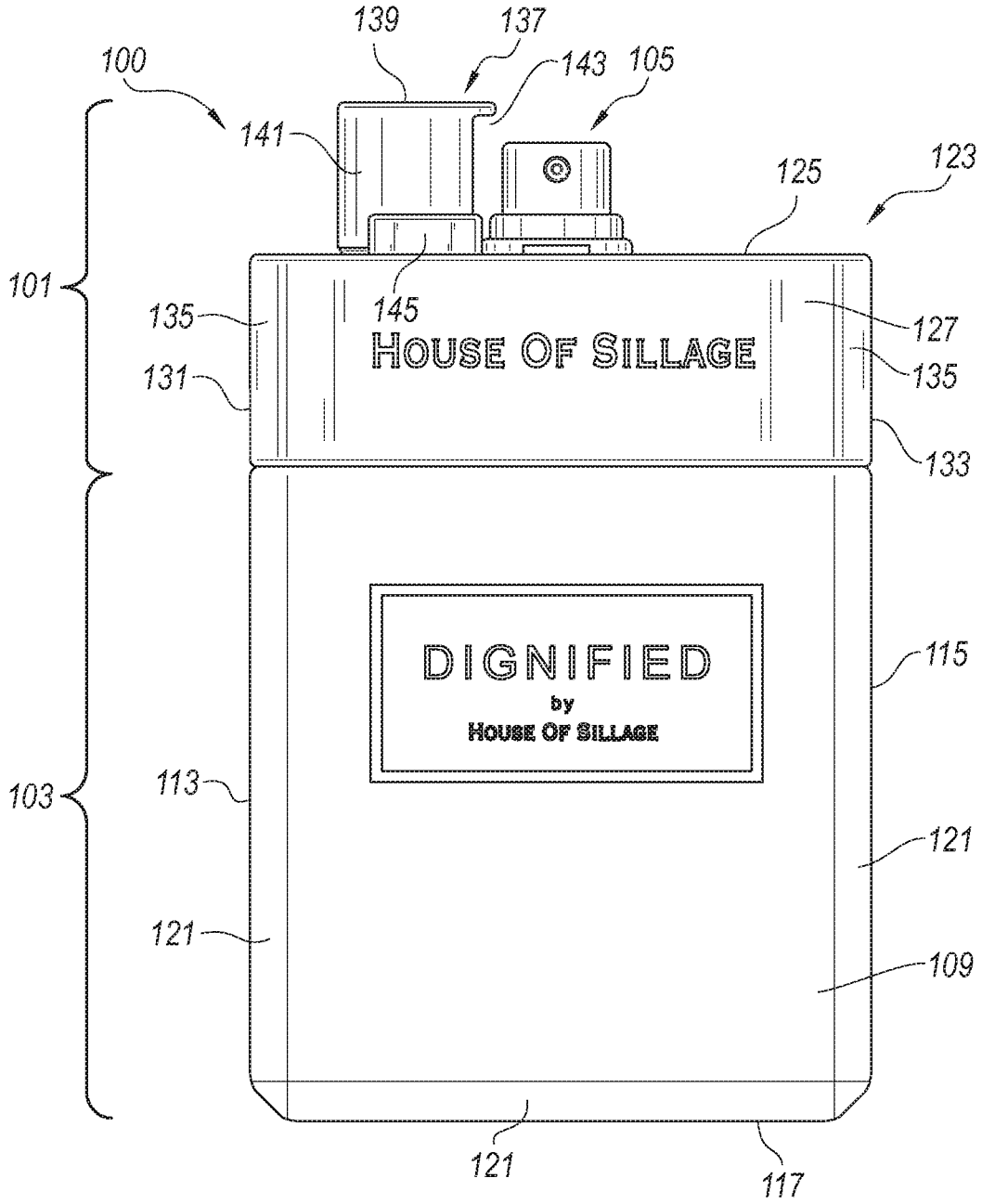
FIG. 1B is a front view of the bottle assembly of FIG. 1A.
Figure 1C:
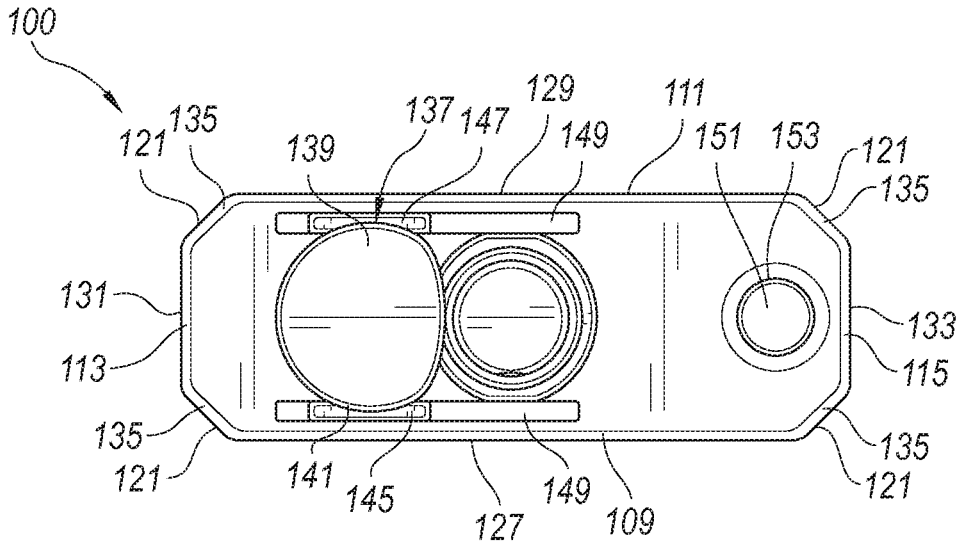
FIG. 1C is a top view of the bottle assembly of FIG. 1A.

FIG. 1A is a perspective view of a bottle assembly with the nozzle cover in an open position, with FIGS. 1B and 1C showing front and top views, respectively. Referring to FIGS. 1A-C together, the illustrated bottle assembly is a fragrance bottle assembly 100 that comprises a cap assembly 101, a bottle 103, and a spray nozzle assembly 105. The spray nozzle assembly 105 includes a spray head 107 that projects from the cap assembly 101. The spray nozzle assembly 105 also includes a tube 108 which extends downwards and into the interior area 110 of the bottle 103. The bottle 103 has a neck that securely and sealably receives the spray nozzle assembly 105 so that liquid fragrance does not spill. Accordingly, at least a portion of the nozzle assembly 105 extends through the cap assembly 101 and into the interior area 110 of the bottle 103. In use, the spray head 107 can be depressed in a pumping motion to draw the liquid fragrance from the interior area 110 of the bottle 103 via the tube 108. The liquid fragrance is then atomized via the spray head 107 and emitted as a mist.

The bottle 103 is configured to hold a liquid fragrance therein such as cologne or perfume. In the illustrated embodiment, the bottle 103 takes the form of substantially a hollow rectangular container with front and rear surfaces 109 and 111, first and second side surfaces 113 and 115, bottom surface 117, and upper surface (not shown). Beveled edges 121 join each of the front and rear surfaces 109, 111 to the first and second side surfaces 113, 115, respectively. However, in other embodiments the bottle 103 can assume various other forms, for example having more or fewer sides, varying shapes, sizes, and curvature, etc. For example, in some embodiments the bottle 103 can omit the beveled edges 121. In other embodiments the bottle can be rounded, for example having a cylindrical shape. The bottle 103 can be made of various materials suitable for holding liquid, for example glass, plastic, metal, etc.

The cap assembly 101 includes a housing 123 configured to fit over the upper portion 124 of the bottle 103. The housing 123 of the illustrated embodiment has a substantially planar upper surface 125, front and rear surfaces 127, 129, first and second side surfaces 131, 133, and beveled edges 135 which join each of the front and rear surfaces 127, 129 to the first and second side surfaces 131, 133, respectively. In the illustrated embodiment, the front and rear surfaces 127, 129 of the cap assembly 101 are configured to be substantially aligned with the front and rear surfaces 109, 111 of the bottle 103. Similarly, the first and second side surfaces 131, 133 of the cap assembly 101 are configured to be substantially aligned with first and second side surfaces 113, 115 of the bottle 103, and the beveled edges 135 of the cap assembly 101 are substantially aligned with the vertically oriented beveled edges 121 of the bottle 103. In other embodiments the housing 123 can assume various other shapes. For example, in some embodiments the shape of the housing 123 may not correspond to the shape of the bottle 103, such that the housing 123 has a smaller or larger footprint than that of the bottle 103. In some embodiments the housing 123 can omit the beveled edges 135. In other embodiments the housing 123 can be rounded or take other shapes. In the illustrated embodiment, the housing 123 covers only the upper portion 124 of the bottle 103. In other embodiments, the housing 123 can cover substantially more of the bottle 103, or even the entire bottle 103. The housing 123 can be made of a single unitary piece or can comprise multiple pieces. The cap assembly 101 can be metal, plastic, glass, and/or other suitable material. In some embodiments, the cap assembly 101 can be made of the same material as the bottle 103, or in other embodiments the materials can differ.

A nozzle cap 137 is disposed over the upper surface 125 of the housing 123. The nozzle cap 137 includes a top wall 139 and a side wall 141. As illustrated, the top wall 139 is planar and the side wall 141 is an arcuate side wall with an opening 143 that faces toward the spray head 107 when the nozzle cap 137 is in the open position as shown in FIGS. 1A-1C. In some embodiments, the nozzle cap 137 can have different shapes, for example with planar side walls forming a rectangle with an open face, with a non-planar top surface, etc. The nozzle cap 137 also includes first and second extensions 145, 147 coupled to lower portions of the side wall 141 on opposite sides. The first and second extensions 145, 147 protrude into parallel, spaced apart rail openings 149 formed in the upper surface 125 of the housing 123. The rail openings 149 extend laterally along the upper surface 125 of the housing 123. In the illustrated embodiment, the rail openings 149 are elongated and straight, however in other embodiments the rail openings 149 can be curved or assume other configurations.

As illustrated in FIGS. 1A-1C, when the nozzle cap 137 is in the open position, the spray head 107 is accessible by a user. For example, a user can depress the spray head 107 in a pumping motion to emit atomized fragrance from the spray head 107. The nozzle cap 137 is slidable laterally relative to the housing 123 such that the first and second extensions 145, 147 traverse along the rail openings 149 between the open and closed positions.

Figure 2A:
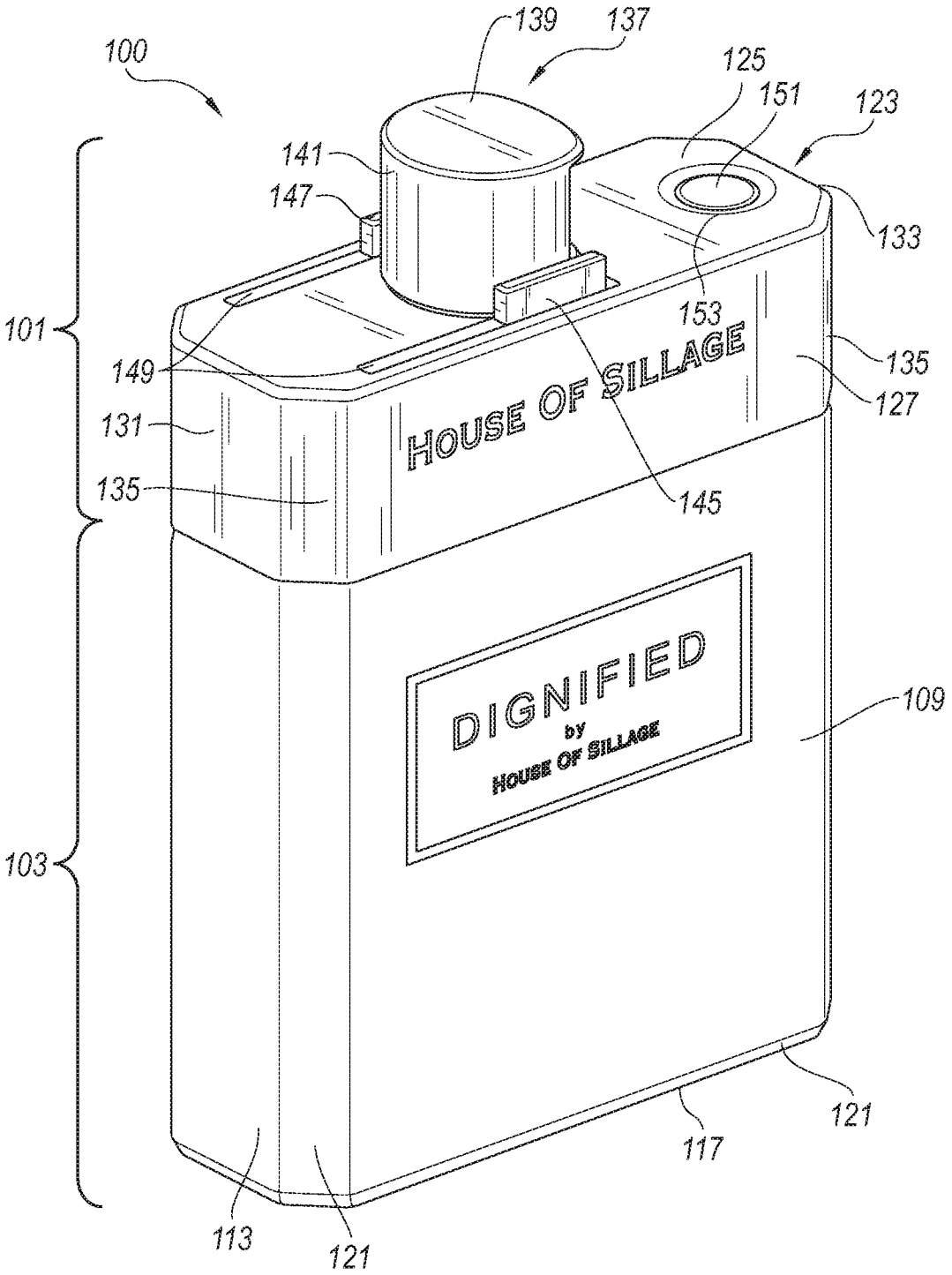
FIG. 2A is a perspective view of a bottle assembly in accordance with an embodiment of the present disclosure, wherein the nozzle cover is shown in a closed position.
Figure 2B:
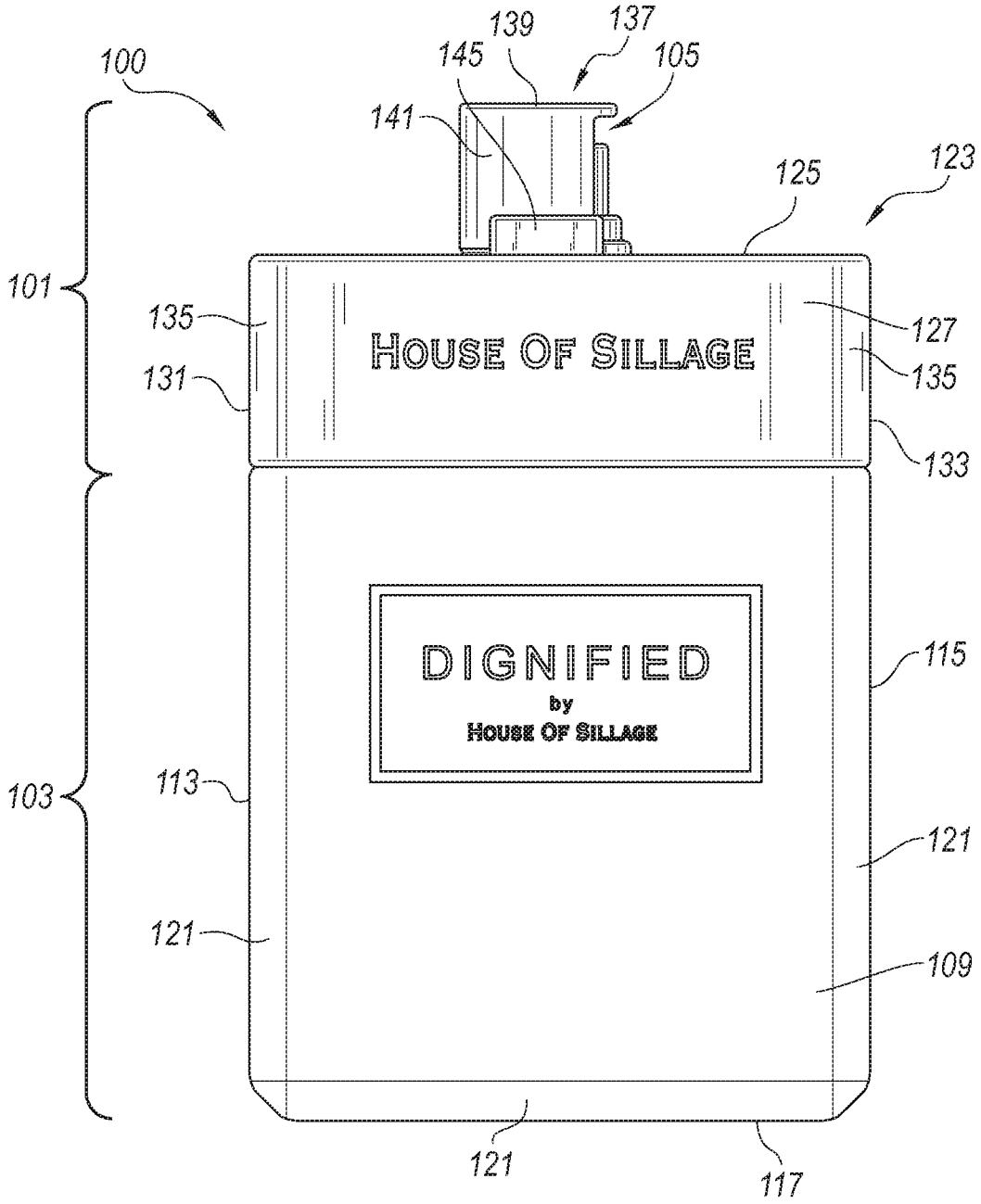
FIG. 2B is a front view of the bottle assembly of FIG. 2A.
Figure 2C:
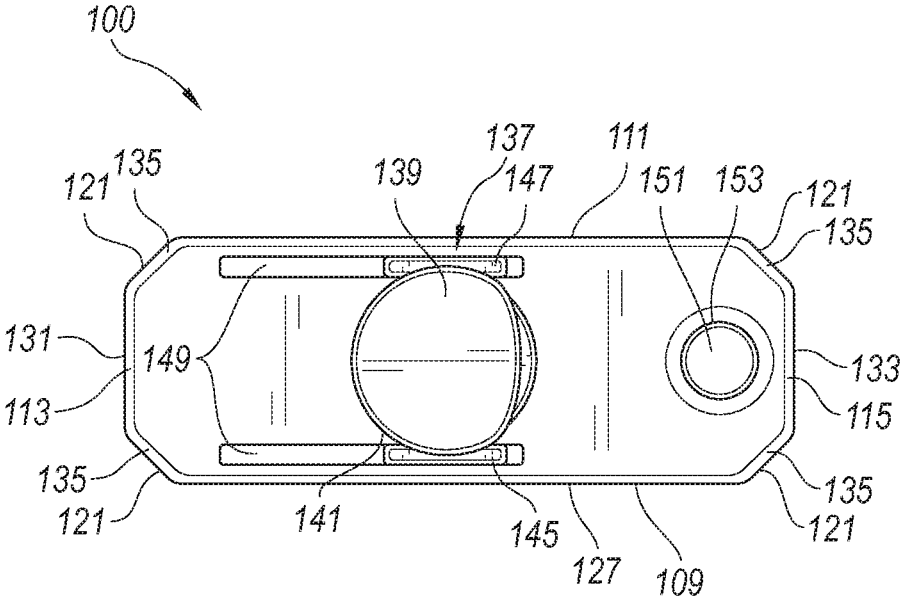
FIG. 2C is a top view of the bottle assembly of FIG. 2A.

FIG. 2A is a perspective view of the fragrance bottle assembly 100 with the nozzle cap 137 in a closed position, with FIGS. 2B and 2C showing front and top views, respectively. Referring to FIGS. 2A-2C together, the nozzle cap 137 is illustrated in the closed position, in which the spray head 107 is substantially covered by the nozzle cap 137. In this position, nozzle cap 137 extends over the top of the spray head 107 and blocks inadvertent engagement or depression of the spray head 107. For example, a user is prevented from inadvertently depressing the spray head 107 and emitting aerosolized fragrance from the fragrance bottle assembly 100. The nozzle cap 137 is movable along the upper surface 125 of the housing 123. In particular, the extensions 145, 147 of the nozzle cap 137 are slidable along the rail openings 149 between the open position (FIGS. 1A-1C) and the closed position (FIGS. 2A-2C).

The nozzle cap 137 can be spring-biased toward the open position (FIGS. 1A-1C). From the open position, a user can manually slide the nozzle cap 137 over the spray head 107 and into the closed position (FIGS. 2A-2C) at which point the nozzle cap 137 can engage a retention mechanism to be releasably locked into place in the closed position over the spray head, as described in more detail below. A release button 151 coupled to the retention mechanism is disposed within a button aperture 153 on the upper surface 125 of the housing 123 and spaced laterally apart from the spray head 107. By pressing the release button 151 when the nozzle cap 137 is in the closed position (FIGS. 2A-2C), a user can release the nozzle cap from the closed position, at which point the spring-biased nozzle cap 137 will automatically slide laterally along the upper surface 125 of the housing 123 to the open position (FIGS. 1A-1C). In some embodiments, the release button 151 can take other forms, for example having varying shapes, a switch, dial, or other actuation mechanism. Additionally, the release button 151 can be positioned in other places with respect to the housing 123, for example on front or rear surfaces 127, 129, side surfaces 131, 133, or beveled edges 135. In some embodiments, the release button 151 can be recessed, flush, or can project from the upper surface 125 of the housing 123.

Figure 3:
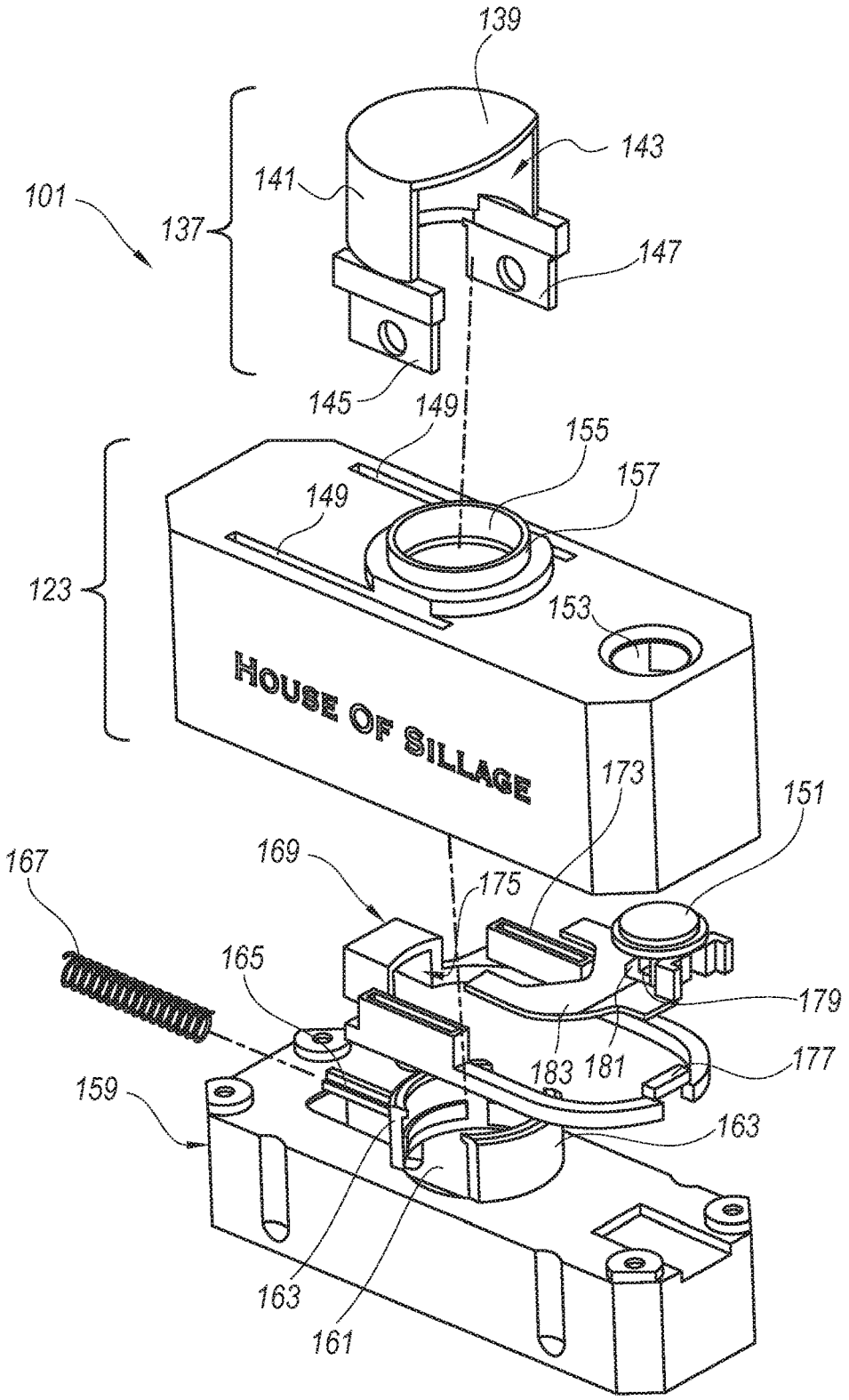
FIG. 3 is an exploded perspective view of a cap assembly in accordance with an embodiment of the present disclosure.

FIG. 3 is an exploded perspective view of the cap assembly 101. As illustrated, the nozzle cap 137 is configured to slidably mate with the housing 123 by inserting the first and second extensions 145, 147 of the nozzle cap 137 into the rail openings 149 on the upper surface 125 of the housing 123. The housing 123 includes the button aperture 153 for receiving the release button 151 therethrough, as well as a first nozzle opening 155 configured to receive a spray head 107 (FIGS. 1A-1C) therein. The first nozzle opening 155 can be surrounded by a first neck portion 157 in the form of a raised annular wall. In other embodiments the nozzle opening 155 and the first neck portion 157 can take other shapes or configurations, for example rectangular, polygonal, elliptical, or other geometric shapes.

The housing 123 is configured to fit over a base 159. The base 159 can receive or otherwise engage the upper portion of the bottle 103, and has a hole to receive the neck of the bottle 103. The base 159 includes a second nozzle opening 161 substantially aligned with the first nozzle opening 155 of the housing 123. The second nozzle opening 161 is surrounded by a second neck portion 163 in the form of raised semi-annular walls. The second nozzle opening 161 and second neck portion 163 can likewise assume other shapes or configurations in other embodiments, for example rectangular, polygonal, elliptical, etc. An alignment pin 165 projects laterally from the second neck portion 163 and is configured to receive a spring 167 thereover. The alignment pin 165 of the illustrated embodiment has a "+" cross-sectional shape, but in other embodiments the shape of the alignment pin can vary. In the illustrated embodiment, the spring 167 is a helical coil spring, however in other embodiments the spring 167 can take other forms, for example a resilient polymer or other elastic component that exerts a counter-force in response to extension, compression, or other deflection.

A slide member 169 is positioned over the base 159 and beneath the housing 123. The slide member 169 includes first and second receptacles 171, 173 that receive the first and second extensions 145, 147 of the nozzle cap 137. The first and second extensions 145, 147 can be fastened within the first and second receptacles 171, 173 respectively, via friction fit, an adhesive, mating projections and recesses, or other such fasteners. With the first and second extensions 145, 147 fastened within the first and second receptacles 171, 173, the nozzle cap 137 and the slide member 169 are fixed and move together in unison relative to the housing 123 and the base 159. As the nozzle cap 137 slides relative to the housing 123 along rail openings 149 between the open and closed positions, the slide member 169 moves under the rail openings 149 between the base 159 and the housing 123.

The slide member 169 includes a socket 175 configured to receive the spring 167 therein. One end of the spring 167 that surrounds the alignment pin 165 is in contact with the second neck portion 163 and the other end of the spring 167 is in contact with the socket 175 of the slide member 169. In this configuration, the spring 167 exerts a force on the slide member 169 to urge it away from the neck portion 163, i.e., so that the nozzle cap 137 is biased away from the closed position and toward the open position. The biasing force of the spring 167 is sufficiently low so that a user can manually overcome the spring bias by pressing laterally on the nozzle cap 137 to slide the nozzle cap 137 to the closed position over the spray head 107.

The slide member 169 also includes a latch bar 177 disposed at the end opposite to the socket 175. The latch bar 177 is configured to engage with a hook 179 coupled to the release button 151. The hook 179 includes a chamfered edge 181 that faces the latch bar 177 such that when the latch bar 177 is pressed laterally against the hook 179, such as when the nozzle cap 137 moves laterally and approaches the final closed position, the latch bar 177 slides along the chamfered edge 181 and forces the release button 151 and hook 179 to depress temporarily relative to the housing 123. When the nozzle cap 137 reaches the final closed position, the latch bar 177 moves laterally past the hook 179, thereby allowing the latch bar 177 to be retained within the hook 179.

A button restraint bar 183 is attached to the interior surface of the housing 123 at a position laterally spaced apart from the release button 151. The button restraint bar 183 exerts an upward force on the release button 151. The button restraint bar 183 can exert a spring-like force on the release button 151 that can be overcome by a user depressing the release button 151 or by the latch bar 177 contacting the chamfered edge 181 of the hook 179. Accordingly, the button restraint bar 183 urges the release button 151 to return to its original raised position after being depressed by a user, or after being lowered by the latch bar 177 sliding over the chamfered edge 181 of the hook 179. In other embodiments other mechanisms can be used to return the release button 151 to its original position, for example an elastic component coupling the release button 151 to the housing 123.

Figure 4:
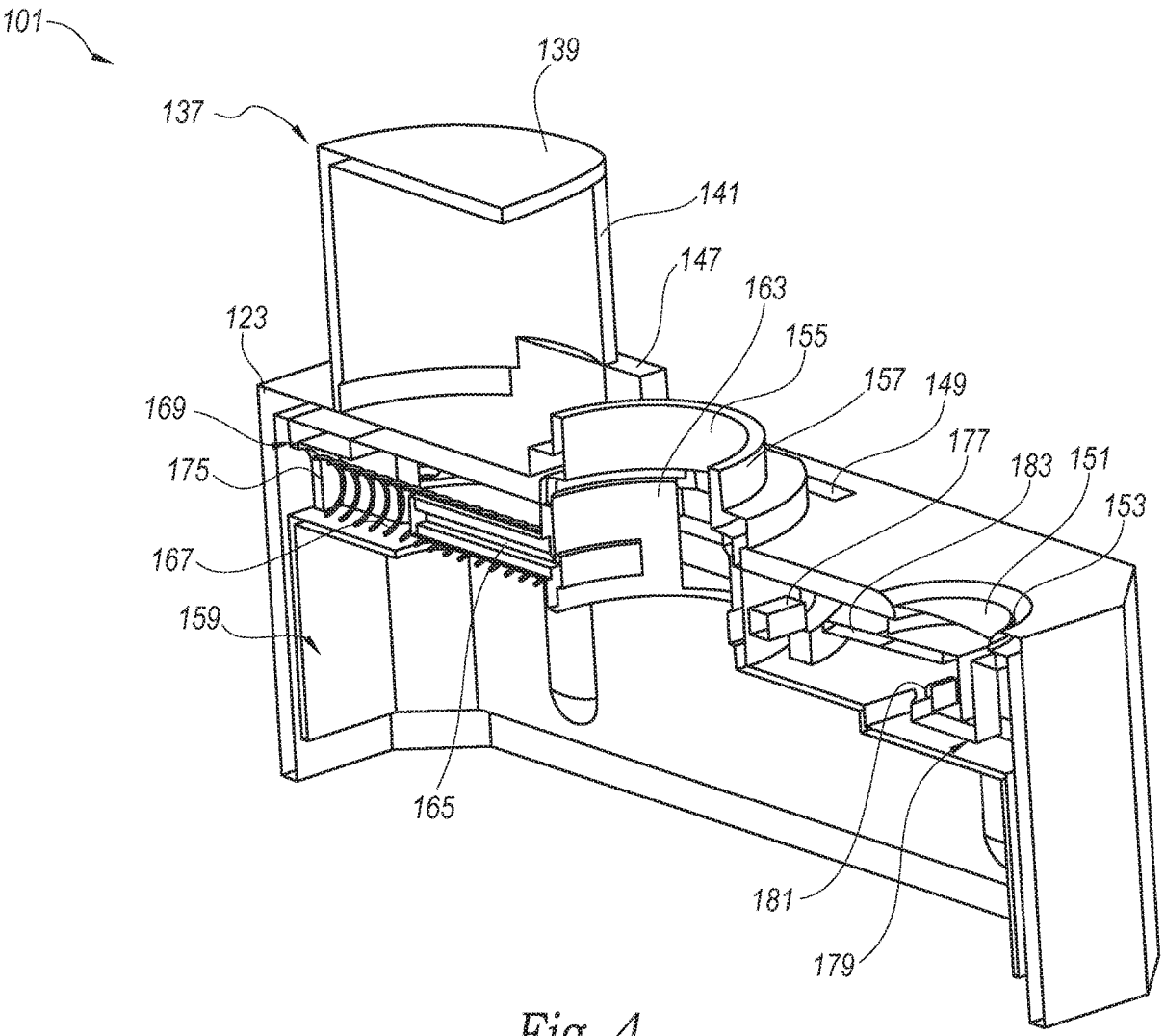
FIG. 4 is a perspective cross-sectional view of a cap assembly in accordance with an embodiment of the present disclosure, wherein the nozzle cap is shown in an open position.

FIG. 4 is a perspective cross-section of the cap assembly 101 with the nozzle cap 137 in the open position. As illustrated, at least a portion of the the spring 167 is positioned over the alignment pin 165 and exerts a lateral force against the socket 175, which urges the slide member 169 away from the release button 151. Since the nozzle cap 137 is connected to the slide member 169 via first and second extensions 145, 147, the nozzle cap 137 is urged away from the release button 151 toward the open position thereby fully exposing the spray head 107 (FIG. 1A). The button restraint bar 183 is disposed beneath the release button 151 and exerts an upward force on the release button 151 and the hook 179 to which the release button 151 is coupled. The base 159 is mated to the housing 123, for example via an adhesive, fasteners, or friction fit. The base 159 is configured such that, upon mating with the housing 123, sufficient space is maintained therebetween so that the slide member 169 is still free to move laterally relative to the base 159 and the housing 123.

Figure 5:
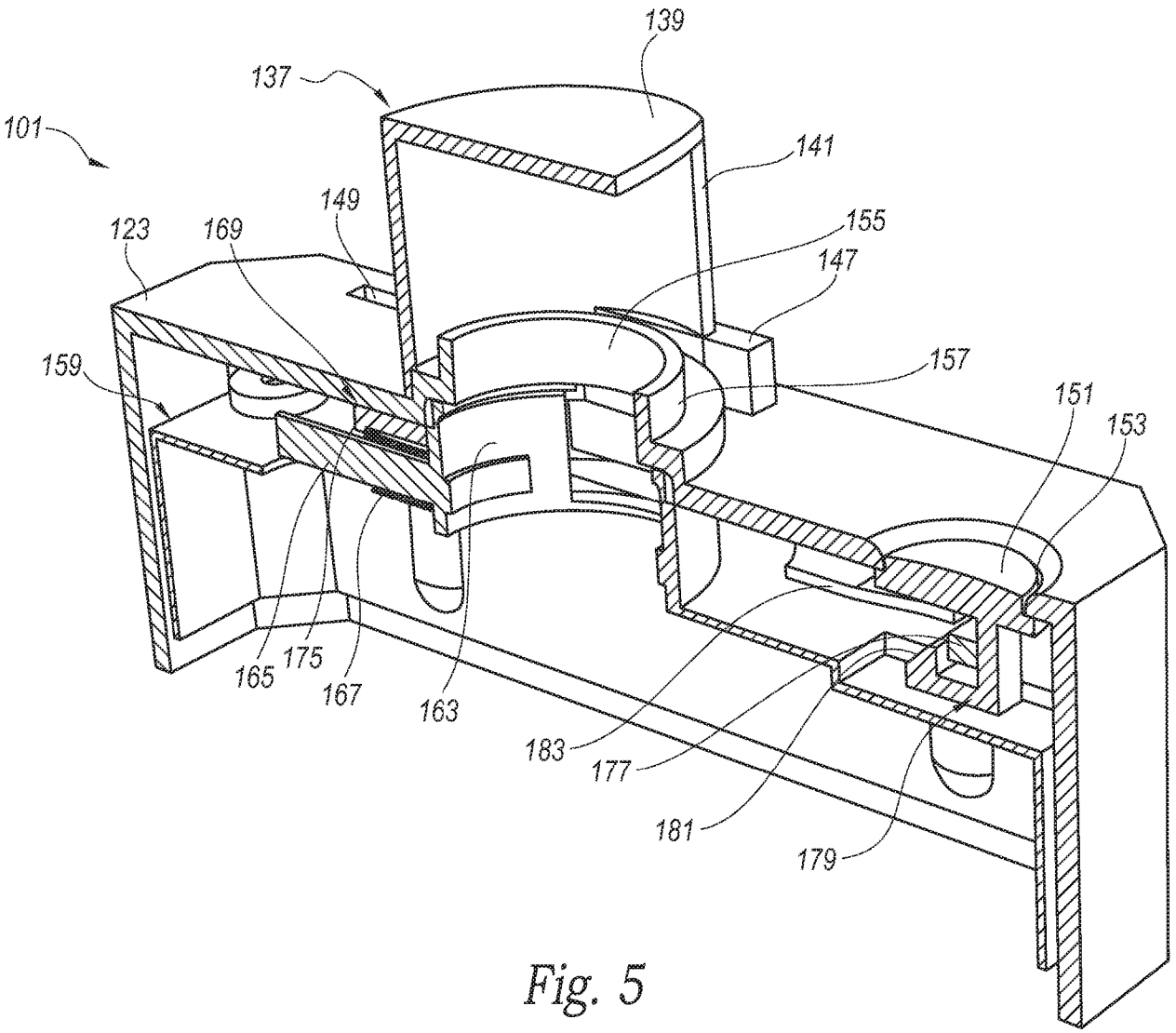
FIG. 5 is a perspective cross-sectional view of a cap assembly in accordance with an embodiment of the present disclosure, wherein the nozzle cap is shown in a closed position.

FIG. 5 is a perspective cross-section of the cap assembly 101 with the nozzle cap 137 in the closed position. As illustrated, the slide member 169 is positioned closer to the release button 151 such that the spring 167 is compressed between the socket 175 and the second neck portion 163. The latch bar 177 is releasably retained by the hook 179 coupled to the release button 151, such that the nozzle cap 137 remains in the closed position covering the spray head 107 (FIG. 2B). Together the latch bar 177 and the hook 179 constitute a retention mechanism which keeps the slide member 169 in position while offsetting the opposing force exerted by the spring 167. Once the release button 151 is depressed, the hook 179 is lowered below and out of engagement with the latch bar 177, thereby allowing the spring 167 to push the slide member 169 laterally, so that the nozzle cap 137 automatically moves to the open position. The upward force exerted by the button restraint bar 183 returns the release button 151 to its original raised position substantially flush with the upper surface 125 of the housing 123 and ready to releasably hold the slide member 169 in place when the nozzle cap 137 is again moved laterally so the nozzle cap 137 is in the closed position.

The use of a slidable nozzle cap and a push-button release of the illustrated embodiments provides several benefits over existing fragrance bottle assemblies. For example, the slidable nozzle cap is attached to the cap assembly and is not separable or removable as in conventional fragrance bottles. As a result, there is no risk of losing or misplacing the nozzle cap. Additionally, the push-button release mechanism also allows for easy one-handed operation of the fragrance bottle assembly, whereas removing a separable nozzle cap typically involves using two hands. Accordingly, the slidable nozzle cap provides the benefits of protecting the spray head with a cap while the push-button release delivers ease and efficiency of access to the spray head for use.

From the foregoing, it will be appreciated that specific embodiments of the invention have been described herein for purposes of illustration, but that various modifications may be made without deviating from the scope of the invention. Accordingly, the invention is not limited except as by the appended claims.

I claim:

1. A cap for use with a fragrance bottle and a nozzle head connected to the fragrance bottle and being movable between raised and depressed positions, comprising:

a housing coupleable to an upper portion of the fragrance bottle, the housing having and upper surface having a nozzle opening configured to receive the nozzle head therethrough;

a nozzle cover connected to and laterally moveable along the upper surface relative to the nozzle opening between a closed position disposed over the nozzle opening and an open position laterally spaced away from the nozzle opening, wherein the nozzle cover is coupled to a spring-biased sliding member configured to bias the nozzle cover toward the open position, the nozzle cover having a sidewall substantially normal to the upper surface and having a sidewall opening, wherein the nozzle head passes through the sidewall opening when the nozzle cover moves laterally between the first and second positions, wherein the nozzle cover in the closed position blocks the nozzle head from being moved from the raised position to the depressed position, and the nozzle cover being spaced laterally apart from the nozzle head when in the open position to allow the nozzle head to be depressed axially toward the planar upper surface from the raised position to depressed position; and a retention mechanism configured to engage with the sliding member to releasably retain the nozzle cover in the closed position.

2. The cap of claim 1 further comprising a release button coupled to the retention mechanism, the release button configured such that depressing the release button disengages the retention mechanism from the sliding member, thereby allowing the nozzle cover to move away from the closed position.

3. The cap of claim 1 wherein the sliding member is disposed beneath the upper surface, and wherein the nozzle head comprises extensions that extend through rail openings in the upper surface to mate with the sliding member.

4. The cap of claim 3 wherein the sliding member comprises a first end;

a second end opposite the first end;

receptacles configured to mate with the extensions of the nozzle cover; and an aperture disposed between the first end and the second end, the aperture disposed around a neck of the nozzle opening.

5. The cap of claim 4 further comprising a spring disposed between the first end of the sliding member and the neck of the nozzle opening.

6. The cap of claim 1 wherein the nozzle cover comprises an open side portion that faces the nozzle opening when the nozzle cover is in the open position.

7. The cap of claim 1, further comprising a biasing member coupled to the nozzle cover, wherein the biasing member is configured to automatically move the nozzle cover to the open position when the retention member is released.

8. The cap of claim 1, wherein the retention mechanism comprises a hook configured to engage a bar coupled to the nozzle cover to retain the nozzle cover in the closed position, wherein depressing the release button moves the hook and releases the bar, thereby allowing the nozzle cover to move away from the closed position.

9. The cap of claim 1 wherein the upper surface is a flat, planer surface.

10. The cap of claim 1 wherein the housing has one or more sidewalls normal to the upper surface and configured to define a hollow area that fits over the top portion of the fragrance bottle.

11. The cap of claim 1, further comprising a biasing member having first and second end portions, the first end portion being coupled to the housing at a fixed position and not movable relative to the upper surface, and the second end being coupled to the nozzle cover and movable with the nozzle cover relative to the upper position between the open and closed positions.

12. The cap of claim 1, further comprising a release member coupled to the retention member and being activatable to disengage the retention member from the sliding member to allow the nozzle cover to move to the open position.

* * * * *